US005988178A

United States Patent [19]

Bair

[11] Patent Number: 5,988,178

[45] Date of Patent: Nov. 23, 1999

[54] NAIL TIP SIZING TOOL AND METHOD OF MANUFACTURE THEREOF

[76] Inventor: Christina S. Bair, 942 Bent Rd., Hatfield, Pa. 19440

[21] Appl. No.: 09/146,966

[22] Filed: Sep. 4, 1998

[51] Int. Cl.[6] ..... A45D 29/00; A45D 29/18

[52] U.S. Cl. ..... 132/73; 132/73.5; 132/285; D28/56; D28/57

[58] Field of Search ..... 132/73, 73.5, 285; D28/56, 57, 61, 99, 9

[56] References Cited

U.S. PATENT DOCUMENTS

| | | | |
|---|---|---|---|
| D. 293,839 | 1/1988 | Wienslaw . | |
| D. 299,878 | 2/1989 | Wienslaw | D28/3 |
| D. 309,196 | 7/1990 | Lajoie | D28/56 |
| D. 386,823 | 11/1997 | Carroll et al. | D28/56 |
| 3,722,104 | 3/1973 | Enzetti . | |
| 4,140,139 | 2/1979 | Aylott | 132/73 |
| 5,070,892 | 12/1991 | Trematerra | 132/73 |
| 5,450,864 | 9/1995 | Lajoie et al. | 132/73 |
| 5,570,793 | 11/1996 | Killough | 132/73 |
| 5,791,482 | 8/1998 | Murphy | 132/73 |

FOREIGN PATENT DOCUMENTS

| | | | |
|---|---|---|---|
| 522108 | 2/1951 | Canada | 132/73 |
| 1017199 | 1/1966 | United Kingdom | 132/73 |
| 1185186 | 3/1970 | United Kingdom | 132/73 |

*Primary Examiner*—John J. Wilson
*Assistant Examiner*—Robyn K. Doan
*Attorney, Agent, or Firm*—Diller, Ramik & Wight, PC

[57] ABSTRACT

A method of manufacturing a nail tip sizing tool is performed by providing a handle with at least one slot and a set of artificial nail tips of different widths and lengths with each nail tip having a cuticle end and a tip end. The tip ends of at least selected ones of the nail tips are cut to establish a substantially uniform nail tip length as measured between the cuticle end and the cut tip end. The cut tip ends are then inserted equal distances into at least one slot of the handle such that the cuticle ends of the nail tips are substantially aligned and the nail tips are in adjacent side-by-side relationship in progressively nail tip width size. Since the nail tip sizing tool has nail tips identical to the nail tips stored in "tip boxes" of the operator, once sizing is performed, the selected artificial nail tip is identical to the sized artificial nail tip of the nail tip sizing tool. This assures decreased downtime as well as corresponding aesthetics because of the identity between the nail tips used for sizing via the nail tip sizing tool and the identical nail tips selected from the operator's "tip box."

35 Claims, 2 Drawing Sheets

NAIL TIP SIZING TOOL AND METHOD OF MANUFACTURE THEREOF

BACKGROUND OF THE INVENTION

Prior to applying nail tips or nail forms to one's own hands or those of a client, such hands must be first cleaned and sanitized, each nail plate is then gently etched, debris is dusted off and a pre-primer or other nail preparation is applied to all ten nail beds. By being extra careful, such preparation can proceed relatively quickly absent adverse effects, such as applying excessive primer to the client's skin which can cause skin allergies or burn, not to mention the downtime required to clean up a flood of primer on the client's nails and/or cuticles.

However, the biggest time-waster during the process of applying artificial nail tips to fingers is selecting proper artificial nail tips or nail forms and applying the same to the fingers. Improperly sizing nail tips for the nail bed or poorly fitting the nail tips/nail forms thereto not only results in excessively wasted time, but improperly sized nail tips may have to be removed, discarded, re-sizing begun anew, etc., resulting in both downtime and product waste (discarded nail tips).

Disclosures directed to the proper selection and application of artificial nail tips or nail forms to fingers are disclosed in the following patents:

Enzetti U.S. Pat. No. 3,722,104

Trematerra U.S. Pat. No. 5,070,892

LaJoie et al. U.S. Pat. No. 5,450,864

Wienslaw U.S. Pat. No. D 293,839

Wienslaw U.S. Pat. No. D 299,878

Lajoie U.S. Pat. No. D 309,196

Carroll et al. U.S. Pat. No. D 386,823

Though the latter-noted lists of patents seek a solution to the problem of nail tip/form sizing, such has not been achieved in practice, and it is to the optimum selection and application of nail tips/nail forms to fingers that the present invention is directed.

SUMMARY OF THE INVENTION

The present invention is directed both to a novel method of manufacturing a nail tip sizing tool, its use, and a nail tip sizing tool per se.

In accordance with the manufacturing method, a handle is provided which includes at least one slot and associated therewith are a set of nail tips of different sizes and lengths with each nail tip having a cuticle end a tip end. The tip ends of at least selected nail tips are cut to establish a substantially uniform nail tip length as measured between the cuticle end and the tip end of each nail tip. Thereafter, the cut tip ends of the nail tips are inserted substantially equal distances into the slot or slots such that the cuticle ends are substantially aligned with the nail tips in adjacent side-by-side relationship in progressively changing nail tip width size.

By utilizing the same nail tips in manufacturing the nail tip sizing tool as are eventually applied to the nail beds/fingers, one is assured that upon proper sizing utilizing the nail tip sizing tool, the corresponding nail tips selected for application to the nail beds/fingers will correspond identically to the selected nail tip of the sizing tool. This assures accuracy in nail tip/nail form selection/application and subsequent adherence of artificial nail tips to fingers.

Preferably, the cut tip ends of the artificial nail tips are immovably secured to the handle of the nail tip sizing tool, as by bonding, though the handle can be formed from relatively resilient material and the tip ends can be force-fit in the slot or slots with the resilience of the handle material being sufficient to hold the tip ends secure for future utilization of the nail tip sizing tool.

The nail tips can be inserted in a single relatively long slot of the handle or the handle can include a multiplicity of adjacent slots with one nail tip being inserted in each adjacent slot. However, whether the nail tips are inserted in single or multiple slots, the cut edges of the cuticle ends of the nail tips thereof are substantially in alignment which assures relatively rapid and accurate matching of the nail tips to the fingers.

Once a specific nail tip/nail form has been matched to a finger, that exact same nail tip/nail form is withdrawn from a storage area/nail tip box in which a plurality of like sized nail tips/nail forms are stored. Since the artificial nail tips/nail forms of the nail tip sizing tool correspond identically to the different sizes of the stored artificial nail tips/nail forms, improper sizing of nail tips upon the nail bed of the client's fingers is totally eliminated. Each properly selected nail tip/nail form is thereafter bonded to the appropriate nail bed, filed, its free-edge shaped and subsequently finished and polished to complete the operation in a rapid, cost-efficient and exacting manner accompanied by optimum aesthetic appearance.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
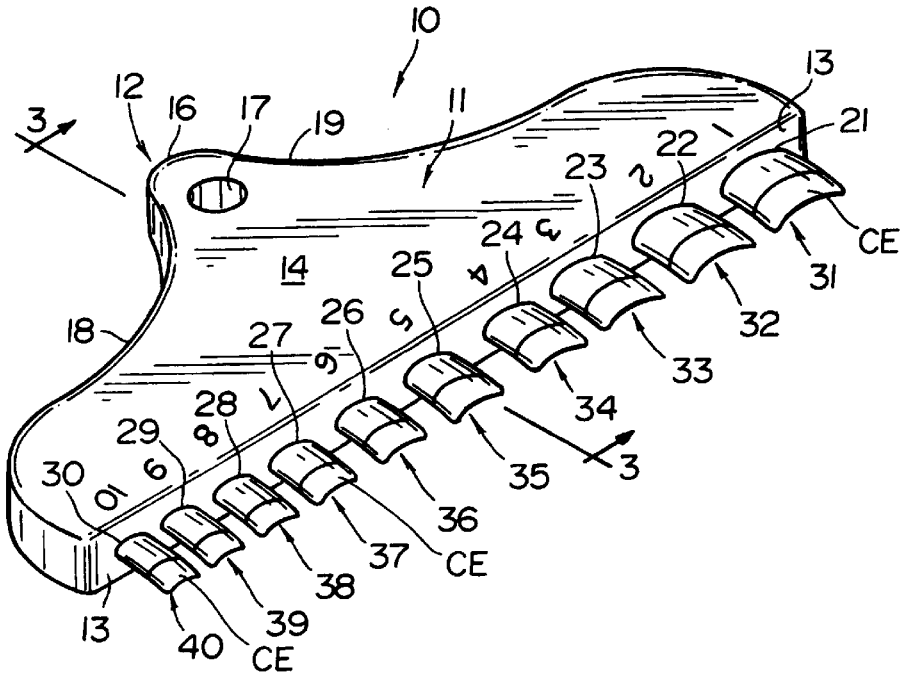
FIG. 1 is a perspective view of a novel nail tip sizing tool constructed in accordance with this invention, and illustrates ten artificial nail tips/nail forms carried by a handle.
Figure 3:
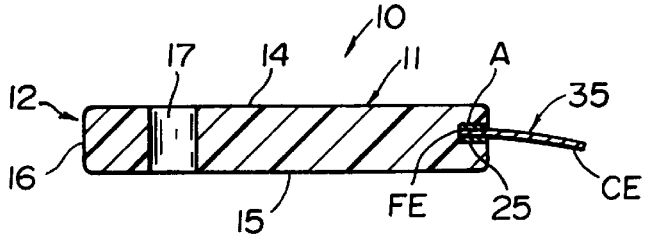
FIG. 3 is an enlarged cross-sectional view taken generally along line 3—3 of FIG. 1, and illustrates the manner in which a cut cuticle edge of the nail tips/nail forms is bonded in a slot of the handle.
Figure 4:
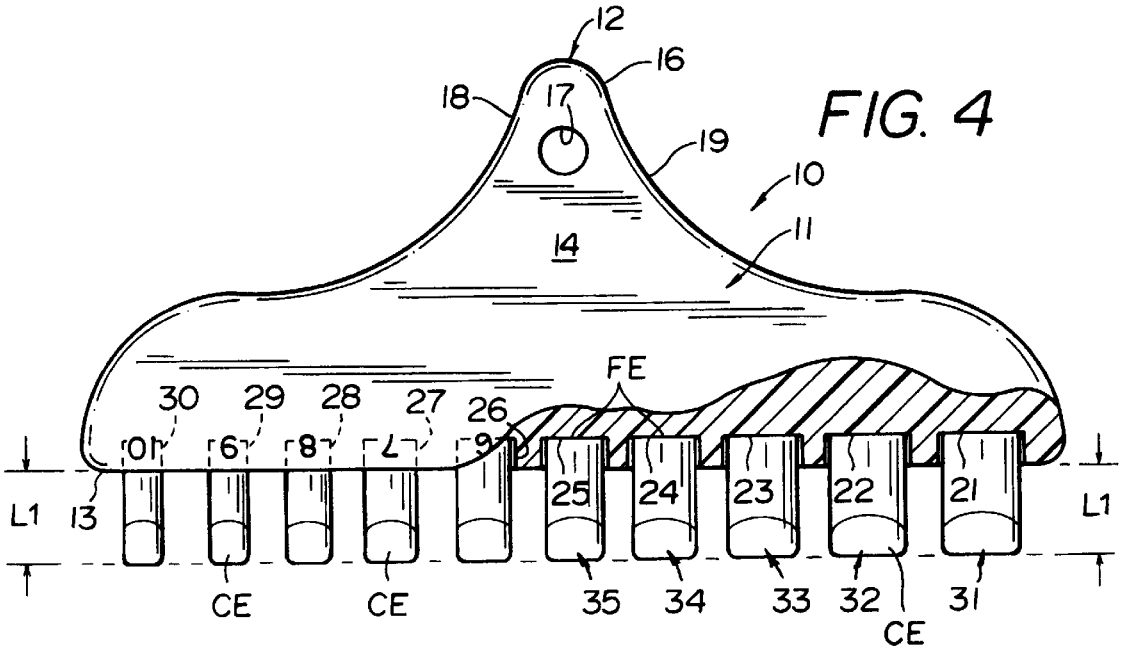
FIG. 4 is a top plan view of the nail tip sizing tool with a portion thereof broken away for clarity, and illustrates the manner in which the nail tips/nail forms are seated in the slots with cut edges of the cuticle ends in alignment with each other.

A novel nail tip sizing tool is fully illustrated in FIGS. 1, 3 and 4 of the drawings and is generally designated by the reference numeral 10.

The nail tip sizing tool 10 includes a handle 11 constructed from injection molded polymeric/copolymeric material, wood, metal, composite or the like. The handle 11 is relatively elongated and includes a rear end portion 12 which projects rearwardly from a front edge portion 13 along which are provided ten slits or slots 21 through 30 which are somewhat curved and are of equal depth. (See FIGS. 3 and 4.) Each slot 21 through 30 houses an artificial nail tip or nail form 31 through 40, respectively, which are initially of different lengths (FIG. 2) and widths. Each of the nail tips 31 through 40 also includes a cuticle end CE having a "well" W and a tip end TE. The artificial nail tips or forms 31 through 40 correspond identically to groups of such artificial nail tips or forms which are stored at the work place, generally in a "tip box," and from which a specific size (width) nail tip is selected for subsequent application to a client's nail bed/finger. Stated otherwise, the nail tips or forms 31 through 40 of FIGS. 1 and 2 correspond identically to the nail tips/nail forms which will be applied by the operator to the fingers of the client.

Figure 2:
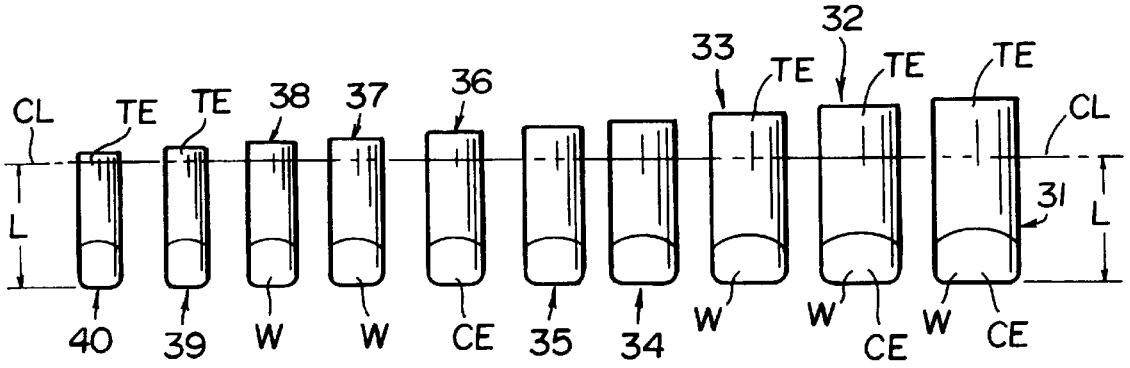
FIG. 2 is a top plan view of the ten nail tips/nail forms, and illustrates the varying lengths and widths thereof incident to being trimmed to a uniform length and united to the handle of the nail tip sizing tool of FIG. 1.

Each of the nail tips 31 through 40 of FIG. 2 is cut to identical lengths L by cutting each tip end TE along a cut line CL (FIG. 2) defining a free edge FE (FIG. 3) of each nail tip 31 through 40. Suitable adhesive A (FIG. 3) is associated with each slot 21 through 30 and each nail tip 31 through 40 is inserted in its respective slot 21 through 30 which results in the nail tips 31 through 40 projecting an equal length L1 (FIG. 4) beyond the front edge portion 13 of the handle 11. An upper surface 14, as well as a lower surface 15 (FIG. 3), of the handle 11 includes the numbers "1" through "10" associated with the respective nail tips 31 through 40 to identify the latter through progressive increasing sizes (widths) from #1 to #10.

The rear end portion 12 of the handle 11 also includes a projection or projecting rear edge 16, two opposite concavely outwardly opening curved rear edges 18, 19, and a hole 17. The projection 16 and the curved rear edges 18, 19 are contoured to provide anatomical symmetry for left-hand or right-hand utilization of the nail tip sizing tool 10 and, of course, the hole or opening 17 allows the nail tip sizing tool 10 to be suspended from a necklace about an operator's neck when in use or simply hung when in storage.

Figure 5:
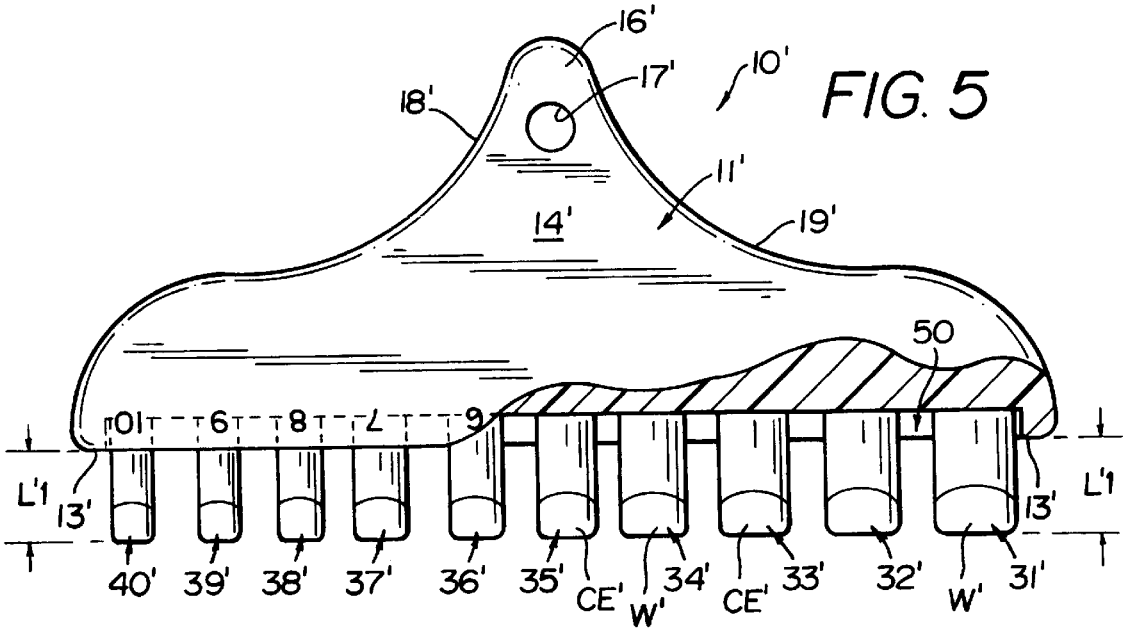
FIG. 5 is a top plan view of another nail tip sizing tool similar to the nail tip sizing tool of FIG. 4, and illustrates the nail tips/nail forms being seated in a single slot of an associated handle.

Another nail tip sizing tool constructed in accordance with this invention is illustrated in FIG. 5 of the drawings and is generally designated by the reference numeral 10'. Structure of the nail tip sizing tool 10' which is identical to that of the nail tip sizing tool 10 is identically numbered and primed. The major difference between the two nail tip sizing tools 10, 10' is that in lieu of the separate individual slots 21 through 30 of the nail tip sizing tool 10, the nail tip sizing tool 10' has a single elongated slot 50 in which are received in spaced adjacent relationship the nail tips 31' through 40'. Additionally, the handle 11' of the nail tip sizing tool 10' is constructed from relatively resilient polymeric/copolymeric injection molded material and the slot 50 thereof is essentially linear and is narrower than the thickness of the nail tips 31' through 40'. Thus, the nail tips 31' through 40' are force-fit into the slot 50 and are held in the position illustrated in FIG. 5 by the nature resilience of the material of the handle 11'. However, adhesive can be used for bonding the nail tips 31' through 40' in the position illustrated in FIG. 5 in relatively spaced parallel relationship to each other.

Each of the nail tip sizing tools 10, 10' is used in essentially the same fashion, assuming first that the client's hands or the user's hands have been cleansed, sanitized, etched, washed, dried, pre-primed or otherwise prepared. Thereafter, either nail tip sizing tool 10, 10' is grasped and held adjacent the nail plate/finger/nail bed to which an artificial nail tip is to be applied. The cuticle ends CE or CE' can be quickly visually correctly sized to a particular nail. (Not all artificial nail tips will fit the nail plate perfectly, but the larger size nail tip is used by filing appropriately to fit the nail plate.) After the correct nail tip size (width) is determined by utilizing the nail tip sizing tool 10, 10', the identical size nail tip is selected from the operator's box of nail tips and is applied in a conventional manner to the nail plate or bed. Thus, since the artificial nail tips 31 through 40, 31' through 40' correspond identical to the stored artificial nail tips of the operator, there is optimum assurance that the nail tip selected from the "tip box" is the correct size for the nail plate to which it is to be applied. Thus, the nail tip sizing tool 10, 10' minimizes the time it takes to fit the artificial nail tip (tips) to a particular nail plate absent fumbling through different nail tip sizes in the operator's tip box. Most importantly, the handle 11, 11' and specifically the slots 21 through 30 and 50, respectively thereof will accept whatever type or brand of artificial nail tips are presently in use. Thus, by supplying an operator with only the handle 11, 11', the operator can modify (cut to length) whatever brand nail tips he or she wishes to use, insert these in the slots or slot of the handles 11, 11' and, thus, assure that the identical nail tips used for sizing will be also selected for application to a nail plate. Thus, decreased downtime is assured as well as corresponding aesthetics because of the identity between the nail tips used for sizing and the identical nail tips applied to one's finger. Thus, the nail tip sizing tool 10, 10' is perfect for beginner nail technicians learning to apply artificial nails while advanced nail technicians can complete a full set of nails faster.

Although a preferred embodiment of the invention has been specifically illustrated and described herein, it is to be understood that minor variations may be made in the apparatus without departing from the spirit and scope of the invention, as defined the appended claims.

What is claimed is:

1. A method of manufacturing a nail tip sizing tool comprising the steps of:

(a) providing a handle with at least one slot and a set of nail tips of different sizes and lengths with each nail tip having a cuticle end and a tip end, (b) cutting the tip ends of at least selected ones of the nail tips to establish a substantially uniform nail tip length as measured between cuticle end and cut tip end, and (c) inserting the cut tip ends of the nail tips substantially equal distances into the at least one slot such that the cuticle ends are substantially aligned and the nail tips are in adjacent side-by-side relationship in progressively changing nail tip width size.

2. The method as defined in claim 1 including the step of immovably securing the tip ends to the handle.

3. The method as defined in claim 1 including the step of bonding the tip ends to the handle.

4. The method as defined in claim 1 including the step of forming the handle from relatively resilient material, and the tip ends are secured in the at least one slot by the resilience of the handle material.

5. The method as defined in claim 1 wherein the at least one slot is a single slot.

6. The method as defined in claim 1 wherein the at least one slot is a single substantially straight slot whereby the cuticle ends are in substantially linear alignment.

7. The method as defined in claim 1 wherein the cuticle ends are in substantially linear alignment.

8. The method as defined in claim 7 including the step of immovably securing the tip ends to the handle.

9. The method as defined in claim 7 including the step of bonding the tip ends to the handle.

10. The method as defined in claim 7 including the step of forming the handle from relatively resilient material, and the tip ends are secured in the at least one slot by the resilience of the handle material.

11. A method of applying nail tips to human nails comprising the steps of:

(a) providing a plurality of artificial nail tips of different lengths and widths, (b) cutting tip ends of at least some of the nail tips to substantially equalize the lengths of the nail tips, (c) inserting the cut tip ends of the plurality of nail tips into at least one slot of a tool which retains cuticle ends of the nail tips in substantial linear alignment, (d) sizing a client's nail by physically matching a client's nail with the cuticle ends of the nail tips of the tool until a substantial matching width is achieved between the client's nail and the width-matched nail tip, (e) selecting an artificial nail tip which substantially identically matches the width-matched nail tip from a group of artificial nail tips which are substantially identical to those retained by the tool, and (f) adhering the selected artificial nail tip to the client's width-matched nail.

12. The nail tip applying method as defined in claim 12 wherein the plurality of nail tips of step (a) are positioned in side-by-side adjacent relationship in progressively changing nail tip size.

13. The nail tip applying method as defined in claim 12 wherein step (c) is performed by selecting width-matching nail tips of the same width.

14. The nail tip applying method as defined in claim 12 including the step of performing steps (b), (c) and (d) for each nail of the client to which a nail tip is to be adhered.

15. The nail tip applying method as defined in claim 12 wherein each nail tip is identified with respect to its width, and the group of artificial nail tips are substantially identically identified.

16. The nail tip applying method as defined in claim 13 wherein each nail tip is identified with respect to its width, and the group of artificial nail tips are substantially identically identified.

17. The nail tip applying method as defined in claim 13 including the step of performing steps (b), (c) and (d) for each nail of the client to which a nail tip is to be adhered.

18. The nail tip applying method as defined in claim 13 wherein each nail tip is identified with respect to its width, and the group of artificial nail tips are substantially identically identified.

19. A nail tip sizing tool comprising a handle, a plurality of artificial nail tips of different widths, each nail tip having a cuticle end and a tip end, at least one of said nail tips has a cut tip end, said cut tip ends and said cuticle ends being in substantially linear alignment, said nail tips being disposed in adjacent side-by-side relationship in progressively changing nail tip width size, means for securing each cut tip end to said handle whereby an operator can utilize the nail tip sizing tool by physically width-matching a client's nail with a substantially width-identical nail tip, and said securing means including at least one slot into which said cut tip ends are inserted.

20. The nail tip sizing tool as defined in claim 19 wherein selected ones of said nail tips each has a cut tip end.

21. The nail tip sizing tool as defined in claim 19 wherein each nail tip is of an identical length as measured from cuticle end to tip end.

22. The nail tip sizing tool as defined in claim 19 wherein said cut tip ends are inserted into frictional gripping engagement with said at least one slot.

23. The nail tip sizing tool as defined in claim 19 wherein said handle is constructed from flexible material, and said cut tip ends are inserted into frictional flexible gripping engagement with said at least one slot.

24. The nail tip sizing tool as defined in claim 19 wherein each nail tip is of an identical length as measured from cuticle end to tip end.

25. The nail tip sizing tool as defined in claim 19 wherein selected ones of said nail tips each has a cut tip end and each nail tip is of an identical length as measured from cuticle end to tip end.

26. A nail tip sizing tool comprising a handle including at least one slot in an edge portion opening through an edge-defining surface of said edge portion, a plurality of artificial nail tips of different widths and substantially identical lengths, said nail tips each including a cuticle end and a tip end with selected ones of said tip ends being defined by severed tip end edges, the identical lengths of said nail tips being defined by the distance between each cuticle end edge and the associated selected ones of said tip end severed edges and unsevered tip end edges of remaining nail tips, said tip ends being retained in said at least one slot, and said cuticle end edges each project a substantially identical distance beyond said edge-defining surface.

27. The nail tip sizing tool as defined in claim 26 wherein said edge-defining surface is substantially straight.

28. The nail tip sizing tool as defined in claim 26 wherein said at least one slot is a plurality of slots.

29. The nail tip sizing tool as defined in claim 26 wherein said tip ends are in frictional gripping engagement with said at least one slot.

30. The nail tip sizing tool as defined in claim 26 wherein said handle is constructed of substantially flexible material, and said tip ends are in frictional flexible gripping engagement with said at least one slot.

31. The nail tip sizing tool as defined in claim 27 wherein said at least one slot is a plurality of slots.

32. The nail tip sizing tool as defined in claim 27 wherein said tip ends are in frictional gripping engagement with said at least one slot.

33. The nail tip sizing tool as defined in claim 27 wherein said handle is constructed of substantially flexible material, and said tip ends are in frictional flexible gripping engagement with said at least one slot.

34. The nail tip sizing tool as defined in claim 32 wherein said at least one slot is a plurality of slots.

35. The nail tip sizing tool as defined in claim 32 wherein said handle is constructed of substantially flexible material, and said tip ends are in frictional flexible gripping engagement with said at least one slot.

* * * * *